United States Patent [19]

Page

[11] Patent Number: 4,696,373

[45] Date of Patent: Sep. 29, 1987

[54] TWO-POSITION LADDER PLATFORM

[76] Inventor: Gerald R. Page, 8 Price St., Hopkinton, Mass. 01748

[21] Appl. No.: 890,164

[22] Filed: Jul. 25, 1986

[51] Int. Cl.[4] ..... E06C 7/16

[52] U.S. Cl. ..... 182/121; 248/238

[58] Field of Search ..... 182/120, 121, 122; 248/238

[56] References Cited

U.S. PATENT DOCUMENTS

| | | | |
|---|---|---|---|
| 88,616 | 4/1869 | Dodge . | |
| 211,389 | 1/1879 | Ellicott . | |
| 309,435 | 12/1884 | Bodell . | |
| 352,716 | 11/1886 | Slack . | |
| 362,747 | 5/1887 | Higgins . | |
| 510,194 | 12/1893 | Sellers . | |
| 606,763 | 7/1898 | Lukens . | |
| 1,007,347 | 10/1911 | Flightner . | |
| 1,187,437 | 6/1916 | Lucas . | |
| 1,452,182 | 4/1923 | Butrum . | |
| 1,593,366 | 7/1926 | Singer . | |
| 1,718,885 | 6/1929 | Williams . | |
| 1,800,792 | 4/1931 | Hansen . | |
| 1,943,626 | 1/1934 | Richard . | |
| 2,067,188 | 1/1937 | Hennessy . | |
| 2,174,891 | 10/1939 | Maran . | |
| 2,415,289 | 2/1947 | Jury . | |
| 2,419,727 | 4/1947 | Picone . | |
| 2,432,206 | 12/1947 | Mott . | |
| 2,439,185 | 4/1948 | Patt . | |
| 2,459,437 | 1/1949 | Kreissler et al. | 248/238 |
| 2,500,559 | 3/1950 | Miller . | |
| 2,553,322 | 5/1951 | Kurmer . | |
| 2,578,862 | 12/1951 | Tims | 248/238 |
| 2,910,135 | 10/1959 | Moore | 182/113 |
| 2,984,446 | 5/1961 | Richter | 248/238 |
| 3,454,132 | 7/1969 | Platino et al. | 182/121 |
| 3,511,338 | 5/1970 | Chapman | 182/121 |
| 3,734,236 | 5/1973 | Houtler | 182/121 |
| 3,889,779 | 6/1975 | Kummerlin | 182/223 |
| 4,211,307 | 7/1980 | Ethridge | 182/121 |
| 4,212,371 | 7/1980 | Gaviorno, Jr. | 182/121 |
| 4,425,985 | 1/1984 | Geisel et al. | 182/121 |

FOREIGN PATENT DOCUMENTS

| | | | |
|---|---|---|---|
| 229046 | 12/1958 | Australia | 182/121 |
| 272180 | 12/1950 | Switzerland | 182/121 |

*Primary Examiner*—Reinaldo Machado

*Attorney, Agent, or Firm*—Weingarten, Schurgin, Gagnebin & Hayes

[57] ABSTRACT

A two-position ladder platform designed for operation by a single climber so as to provide the climber with a broad foot support in its erected position and to retract to a recessed position to avoid impairing the climber. The device includes a platform section, preferably rectangular in shape, with platform hooks pivotally mounted along adjacent corners of the platform section. Leg sections extend away from other adjacent corners of the platform and terminate in a forked end. In the erected position the platform hooks engage a first ladder rung with the platform extending outward therefrom while the forked ends engage a ladder rung below the platform. The platform is capable of being inward over the first rung into a recessed position which avoids it becoming an obstruction to the user when climbing the ladder. The platform can be easily kicked back into the erected position to provide the climber with support after he climbs passed it.

6 Claims, 7 Drawing Figures

TWO-POSITION LADDER PLATFORM

BACKGROUND OF THE INVENTION

The prior art devices in the area of ladder mounted platforms have attempted to construct a platform which is easily mounted to the ladder as well as easily removed while at the same time providing a strong and stable surface with an area large enough so that the ladder's climber may comfortably stand while performing work.

The prior art shows several single position devices which have utilized various hook, clamp, or bracket arrangements in order to mount a platform to the rungs of a ladder. The climber, however, in order to mount the platform, must either affix the platform to the rungs and maneuver around it while ascending the ladder or position himself above the desired location of platform and, while balancing on the ladder, lean over and attach the platform. These alternatives are extremely dangerous in at least two respects. First, they are likely to lead to an improper and faulty installation of the platform. Second, the awkwardness of the installation procedure can lead to a fall by the climber or an unbalancing of the ladder, causing it to slide off its support. Similar procedures must also be followed during the process of removing the platform while descending the ladder. As a result, the prior art platforms often require a second person to install the platform for use. This is inefficient and may not always be feasible.

Therefore, the prior art devices either involve two people or require the climber to place his own personal safety at risk in order to not only affix the platform to the ladder, but also disconnect it as well. This defeats the platform's goals of facilitating ladder-based work.

SUMMARY OF THE INVENTION

The present invention is a two-position ladder platform which is capable of being installed or erected by a single user and can be positioned to provide strong, comfortable support and easily retracted to remove the platform as an obstruction to climbing without imposing unnecessary danger upon the climber himself. The purpose of the platform in providing a more comfortable work environment for the climber is thus achieved with safety along with less discomfort and fatigue for him while he is standing on a flat platform rather than having to balance himself on the narrow rung of a ladder.

More particularly, the invention includes a platform section, preferably rectangular in shape, with platform hooks pivotally mounted along adjacent corners of the platform section and leg sections extending away from other adjacent corners of the platform section, each leg section terminating in a forked end. The erected state of the present invention involves engaging the platform hooks on a first rung of the ladder even with the height at which climber wishes to work and mounting the forked hooks to a rung of the ladder below the first rung in order to provide vertical support to the platform. The platform is moved to a recessed position by inwardly pushing the side of the platform section facing away from the ladder, towards the ladder itself such that the platform passes over the first rung of the ladder until the leg sections abut the first rung such that the platform is no longer an obstruction to the climber. The platform is returned to its erected position by pushing the platform away from the ladder and re-engaging the platform hooks, as before.

DESCRIPTION OF THE DRAWINGS

These and other features of the present invention are more fully set forth below in the solely exemplary detailed description and accompanying drawings of which.

DETAILED DESCRIPTION OF THE INVENTION

Figure 1:
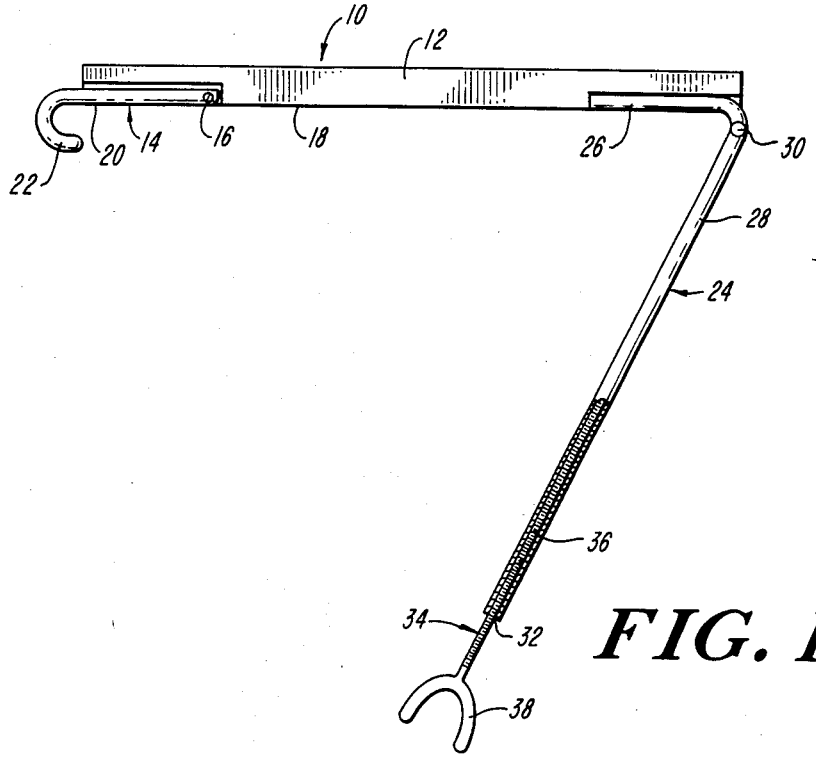
FIG. 1 is a partially cut away diagrammatic view of the side of the platform.

The platform 10 includes a substantially flat platform section 12 of a rectangular shape, the latter constructed of aluminum or other suitable material and which may also include a non-skid surface. The platform section 12 possesses at least one platform hook 14 which is mounted to the platform section 12 at pivot 16 along a corner of the platform section such that side 18 of the platform section can be substantially coplanar with side 20 of platform hook 14. Platform hook 14 also possesses a curved section 22.

Leg section 24 possesses mounted portion 26 and arm portion 28. Arm portion 28 extends away from mounted portion 26 and is affixed to mounted portion 26 at pivot 30. The pivot 30 allows the platform section 12 to move vertically relative to the leg sections during the process of retracting the platform section, as will be discussed below. In the preferred embodiment arm 28 is hollow and threaded such that at its terminal end 32 a fork hook 34 may be mounted thereon. Fork hook 34 possesses a complementary threaded rod portion 36 with a U-shaped hook portion 38 mounted thereto.

Figure 2:
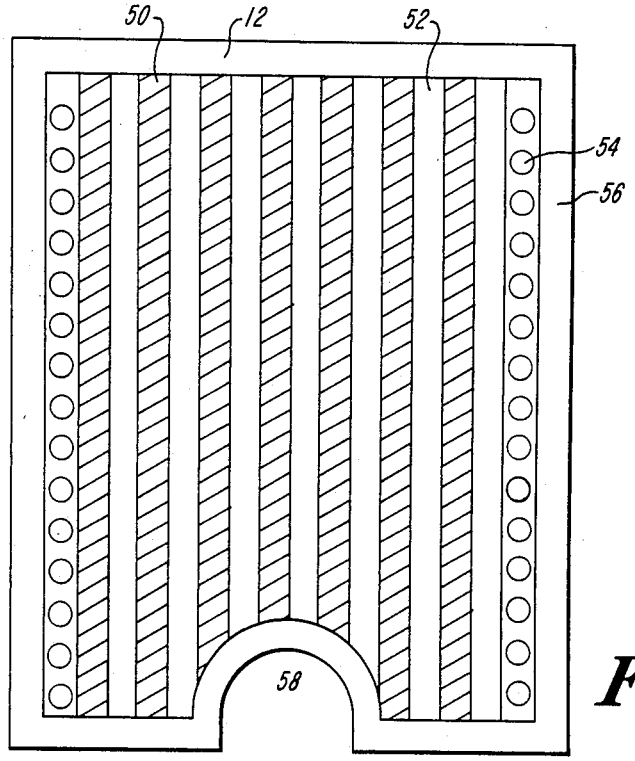
FIG. 2 is a diagrammatic view of the top of the platform section.

In FIG. 2 platform section 12 is made up of a grooved surface with raised portions 50 and depressed portions 52, both of which are arranged in a linear configuration. Drainage holes 54 are arranged in a linear format parallel to the raised and depressed portions. The grooved surface of the platform section is used in conjunction with the drainage holes to channel water through the holes in order to minimize the amount of water on the platform section which could cause a loss of footing by the climber. Border section 56 surrounds the outer periphery of platform section 12. A notched portion 58 is also present in platform section 12 and in the preferred embodiment is U-shaped. The notched portion is such that the climber can place his foot on a rung of the ladder, when the platform is resting in the recessed position against the same rung, as shown by platform 90 in FIG. 3B.

Figure 3A:
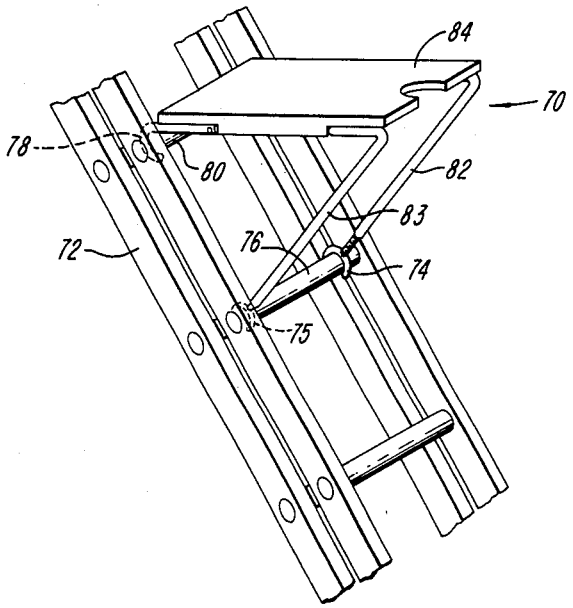
FIGS. 3A and 3B are illustrations of the platform mounted to a ladder in both erected and recessed positions.

In FIG. 3A ladder platform 70 is placed in the erected position on ladder 72 by positioning fork hooks 74 and 75 on rung 76. Platform hook 78 is wrapped around rung 80. Fork hooks 74 and 75 are positioned on arms 82 and 83, respectively, such that the overall length between platform section 84 and fork hooks 74 and 75 permits platform section 84 to be substantially parallel to the ground.

Figure 3B:
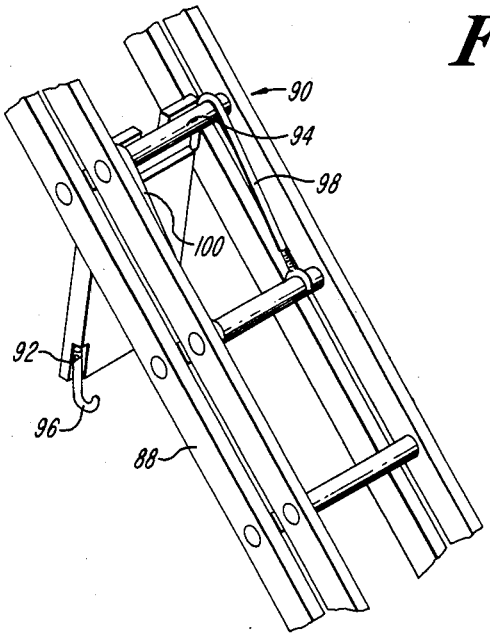
Figure 4A:
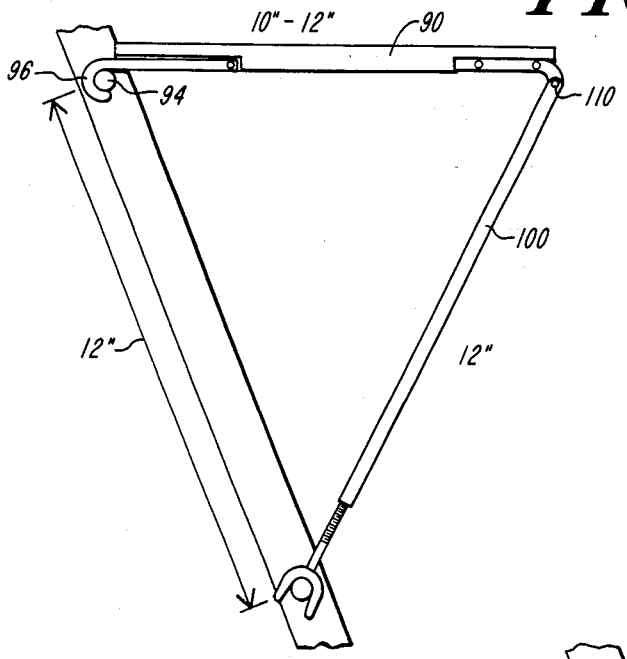
FIGS. 4A, 4B, and 4C show three states of the platform in going between erected and recessed positions.
Figure 4B:
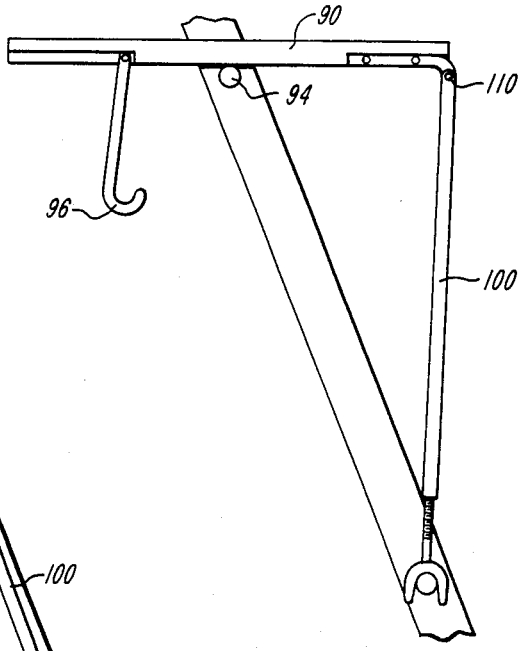
Figure 4C:
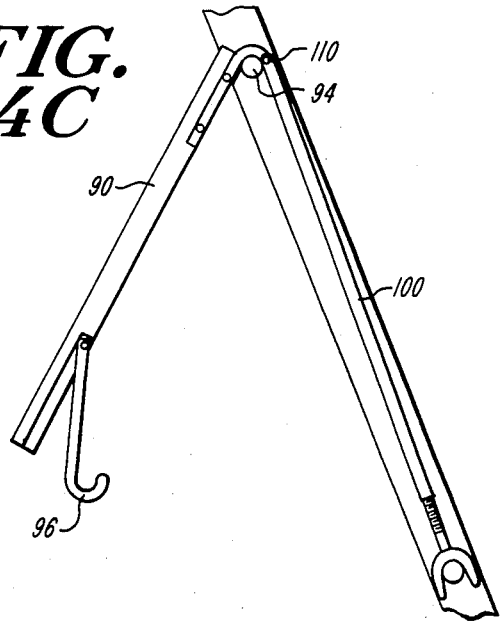

Platform 90 in FIG. 3B shows the recessed position of the platform once it has been moved out of the way of the climber. Platform section 92 has been pushed inwardly towards ladder 88, as shown sequentially in FIGS. 4A, 4B, and 4C, so that hook 96 disconnects from rung 94 through the open end of the hook and platform section 90 pivots vertically on pivot 110 while sliding over rung 94 until leg sections 98 and 100 abut rung 94. Platform 90 can easily be returned to the erected position by pushing out platform section 92 away from ladder 88 such that platform section 92 again slides over rung 94 and re-engages platform hook 96 on rung 94 as is shown by ladder mounted platform 70 in FIG. 3A. During the process of moving the platform from the support position to the retracted position and vice versa, the fork hooks remain in substantial contact with the rung of the ladder on which they were placed, thus requiring the use of a pivot means as shown by pivot 110 in FIGS. 4A, 4B, and 4C.

The present invention is not limited to the above solely exemplary detailed description. Modifications and substitutions by those skilled in the art are considered within the scope of the present invention. Therefore, the present invention is not to be considered limited except by the following claims.

What is claimed is:

1. A support device to be attached to a ladder and capable of being placed in an erected position and a recessed position, respectively, comprising:

a platform section with first and second sides;

at least one platform hook mounted pivotally along said first side of said platform section and designed to be suspended and to engage a first rung of said ladder; and leg sections mounted along said first and second sides of said platform section, each leg section further comprising:

a mounted portion affixed to said platform section, an arm section connected to said mounted portion and including a terminal end distal said mounted portion, and a fork hook adjustably connected to said terminal end of said arm section and wherein said fork hook is extensibly adjustable with respect to said arm section to engage a second rung of said ladder, said second rung located below said first rung, and wherein said leg section is adapted to permit said platform section to move from said erected position to said recessed position by moving said platform section toward said ladder while said platform section passes over said first rung, and said fork hooks rotate around the axis of and remain in substantial contact with said second rung.

2. The support device of claim 1, wherein each said adapted leg section includes a pivot means connecting said mounted section and said arm section.

3. The support device of claim 1 wherein each said fork hook further includes a U-shaped hook portion for engaging said second run and a complementary threaded portion projecting from said U-shaped hook portion, and wherein each said terminal end of said arm section further includes a thread receiving portion for receiving the complementary threaded portion of said fork hook whereby said fork hook is adjustably connected to said arm section.

4. The support device of claim 1 wherein said complementary threaded portion of said fork hook is a projecting portion having an outer threaded surface and wherein said terminal end of said arm section is a hollow tube having an internal thread receiving surface as said thread receiving portion.

5. The support device of claim 1 wherein said platform section further includes a notched portion positioned between said leg sections.

6. The support device of claim 1 wherein said platform section includes a grooved surface having parallel arrays of raised and depressed portions and further including drainage holes formed in at least one of said parallel arrays.

* * * * *